United States Patent [19]

Flanagan, Jr.

[11] Patent Number: 4,883,169

[45] Date of Patent: Nov. 28, 1989

[54] PORTABLE RECEPTACLE FOR RETURNABLE BEVERAGE CONTAINERS

[76] Inventor: Richard E. Flanagan, Jr., P.O. Box 217, West Sand Lake, N.Y. 12196

[21] Appl. No.: 286,167

[22] Filed: Dec. 19, 1988

[51] Int. Cl.[4] ..... B65D 5/36; B65D 6/40; B65D 71/00

[52] U.S. Cl. ..... 206/170; 206/202; 206/429; 220/19

[58] Field of Search ..... 206/170, 198, 427, 429, 206/202, 203; 220/19

[56] References Cited

U.S. PATENT DOCUMENTS

| | | | |
|---|---|---|---|
| 72,801 | 5/1903 | Roudil . | |
| 593,889 | 11/1897 | Horn . | |
| 2,555,102 | 5/1951 | Anderson | 206/202 |
| 2,844,279 | 7/1958 | Kovach | 206/170 |
| 3,628,709 | 12/1971 | Clifton | 224/45 |
| 4,235,331 | 11/1980 | Bates et al. | 206/170 |
| 4,236,638 | 12/1980 | Griffith | 206/493 |
| 4,290,525 | 9/1981 | Sisson | 206/427 |
| 4,300,697 | 11/1981 | Dickens | 220/19 |
| 4,417,657 | 11/1983 | Thibodeau | 206/203 X |
| 4,542,826 | 9/1985 | Adams | 206/427 |
| 4,574,978 | 3/1986 | Hodges | 220/403 |
| 4,664,255 | 5/1987 | Griffith | 206/162 |
| 4,706,805 | 11/1987 | Becher | 206/144 |
| 4,735,313 | 4/1988 | Schoenberg | 206/427 |
| 4,738,363 | 4/1988 | Hudson | 206/427 |

FOREIGN PATENT DOCUMENTS

| | | | |
|---|---|---|---|
| 2196837 | 5/1988 | United Kingdom | 383/12 |

*Primary Examiner*—William Price

*Attorney, Agent, or Firm*—Heslin & Rothenberg

[57] ABSTRACT

A portable receptacle capable of securely and orderly receiving returnable beverage containers for storage and transport is disclosed. The receptacle includes a frame structure definitive of at least one module that is sized to receive a plurality of returnable cans and/or bottles. The module has an outwardly facing open end to facilitate insertion of containers therein, and an at least partially sealed end opposed thereto for positioning the containers. Orienting means are provided for angling containers positioned within the module downwardly from the open end to the at least partially sealed end such that any residue fluid retained within the containers remains therein and such that the containers remain within the receptacle when in transport. Enhancements include the provision of multiple container receiving modules symmetrically arranged within the frame structure, the sizing of each module to receive a returnable can or bottle in tiers, and the manufacture of the receptacle to be collapsible when empty.

16 Claims, 5 Drawing Sheets

PORTABLE RECEPTACLE FOR RETURNABLE BEVERAGE CONTAINERS

BACKGROUND OF THE INVENTION

1. Field of the Invention

The present invention relates to a portable receptacle for empty beverage containers, such as returnable cans and bottles, and particularly to such a receptacle that is capable of securely and orderly receiving cans and bottles for storage and transport.

2. Description of the Prior Art

A number of jurisdictions have enacted laws that require payment of a container deposit to induce consumers to return for recycling many of the beverage cans and bottles sold today. The vendor subsequently refunds the deposit to the customer when an empty can or bottle is returned to the store. Among other things, deposit laws are designed to minimize litter and encourage resource and energy conservation through recycling.

Returnable beverage cans and bottles are often accumulated in such traditional receptacles as boxes and bags for return to the place of purchase. This storage and transport approach, however, has a number of drawbacks, including unsightliness, and often results in an inefficient, nonproductive use of space. In addition, the use of boxes and bags makes it difficult to track the number of accumulated cans and bottles, and therefore the correct amount of deposit credit which should be received upon their return. Further, many customers commonly fill a box or bag to the point of overflowing such that the receptacle is cumbersome and difficult to handle. Also, empty beverage containers are typically haphazardly stored in boxes and bags such that residue fluids in the containers tend to leak therefrom.

Of the existing carriers specifically designed for receiving returnable beverage cans and/or bottles, none are believed to encompass a receptacle wherein returnable cans and bottles are easily and orderly inserted and removed, and wherein cans and/or bottles are secure when the customer is transporting the receptacle back to the place of purchase for return of the empty beverage containers, and, most importantly, wherein residue fluid is prevented from leaking from an open-top beverage container positioned therein. The structures described in U.S. Pat. Nos. 4,738,363, 4,300,697, 4,236,638, 4,664,255, and 4,735,313 are believed representative of the state of the art.

Therefore, there exists a geniune need for an improved receptacle for storing and transporting returnable beverage containers, and more particularly, for such a receptacle wherein returnable cans and bottles are easily and orderly inserted and removed from the receptacle, are securely held in place within the receptacle when in transport, and are positioned such that any residue fluids therein will not readily leak either when being stored or transported within the receptacle.

SUMMARY OF THE INVENTION

The present invention consists of a receptacle for storing and transporting returnable beverage containers for recycling. The receptacle comprises a portable frame structure having at least one module sized to receive a plurality of returnable beverage containers. The at least one module has an outwardly facing open end, which allows easy insertion of containers therein, and an at least partially sealed end opposed thereto for positioning the containers. When positioned within the module, containers are angled downwardly from the open module end to the at least partially sealed end such that any residue fluid retained within the containers remains therein, and such that the containers remain within the portable receptacle when in transport. Further enhancements include the provision of multiple container receiving modules symmetrically arranged within the frame structure, the sizing of each module to receive beverage containers in tiers, and the manufacture of the receptacle to be collapsible when empty.

A principle object of the present invention is to provide an improved receptacle specially designed for efficiently receiving returnable beverage containers.

Another object of the present invention is to provide such a receptacle wherein beverage containers are easily stored in an orderly and secure manner for transport for recycling.

Yet another object of the present invention is to provide a receptacle wherein open containers can be readily stored without the possibility of residue fluid leaking therefrom.

Still another object of the present invention is to provide such a receptacle wherein the number of accumulated beverge containers can be readily determined.

A further object of the present invention is to provide such a receptacle which is collapsible when not in use, is simple in construction, and inexpensive to manufacture.

BRIEF DESCRIPTION OF THE DRAWINGS

These and other objects, advantages and features of the present invention will be more readily understood from the following detailed description of one embodiment of the invention when considered in conjuction with the accompanying drawings in which.

DETAILED DESCRIPTION OF THE INVENTION

Figure 1:
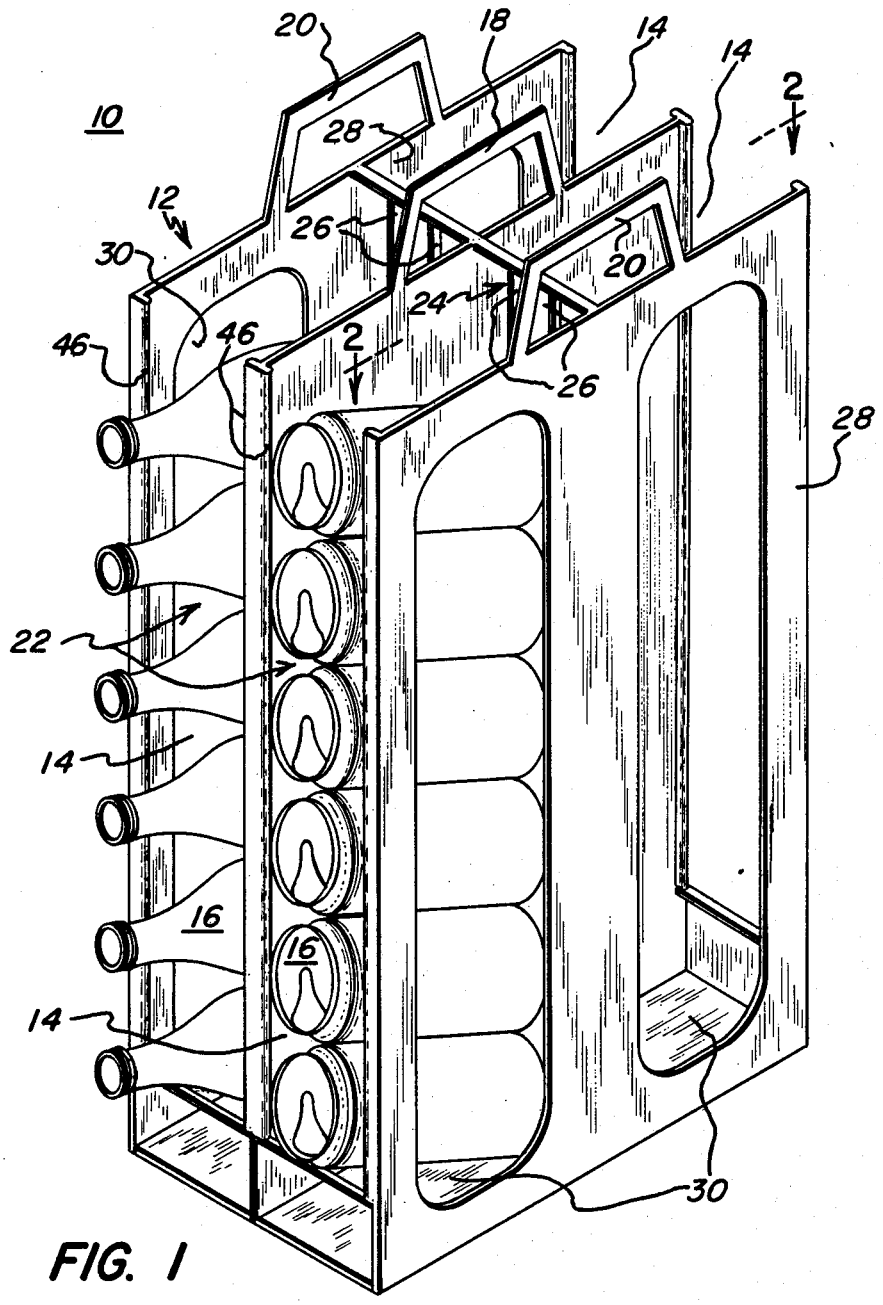
FIG. 1 is a perspective view of an embodiment of the present invention, with a plurality of beverage containers shown positioned therein.

One embodiment of the portable receptacle of the present invention, generally denoted 10, is illustrated in FIG. 1. Receptacle 10 comprises a frame structure 12 definitive of a plurality of returnable beverage container receiving modules 14. As shown, each module 14 is designed to retain six cans and/or bottles, denoted 16, for return for recycling. If desired, the modules can be designed to accommodate any practical number of beverage containers without departing from the scope of the present invention as defined by the appended claims. Modules 14 are symmetrically arranged within frame structure 12 to enhance balanced carrying of receptacle 10. At least one central handle 18, and preferably two outside handles 20, are provided to facilitate carrying of the receptacle.

Each module 14 within structure 12 includes an outwardly facing open end 22 and an at least partially sealed end 24 opposed thereto. Partially sealed end 24 is shown to comprise two substantially vertical strips 26 sized and spaced to engageably position cans and bottles 16 stored within module 14. Sidewalls 28 complete the definition of modules 14. Oblong openings 30 are preferably provided in the outer sidewalls of modules 14 to facilitate counting of accumulated containers 16. As shown, the top of each module 14 is open to facilitate insertion and removal of containers therein.

Figure 2:
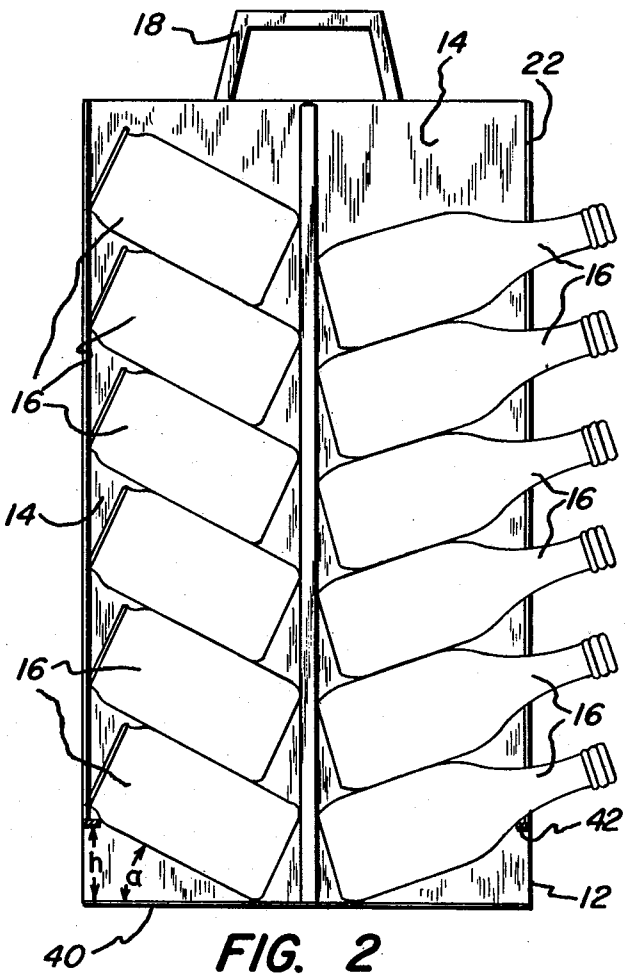
FIG. 2 is a cross sectional view of the receptacle of FIG. 1 along lines 2—2.

Structure 12, preferably manufactured of a plastic material, is constructed such that each module 14 has a bottom surface configured to support containers 16 positioned therein at an acute angle "a" to horizontal. Specifically, as shown in FIG. 2, angle "a" is defined at the innermost edge of a container 16 between the exterior surface of the container and the flat bottom 40 of structure 12. Angling of containers within receptacle 10 as shown beneficially enhances the receptacle's ability to retain the containers, and prevents residue fluid within containers 16 from leaking therefrom when in transport. In practice, angle "a" is preferably within the range of 10° to 50°. If less than 10°, the noted benefits are less substantial and if greater than 50°, the height of receptacle 10 becomes unwieldy. In the embodiment shown, the container supporting structure of each module 14 consists of the frame structure's flat bottom 40 and a bar or strap 42 spaced several inches above the bottom at the outward facing open end 22 (see FIGS. 1 and 3). Varying the height "h" of straps 42 relative to bottom 40 results in a concomitant change in angle "a".

Figure 3:
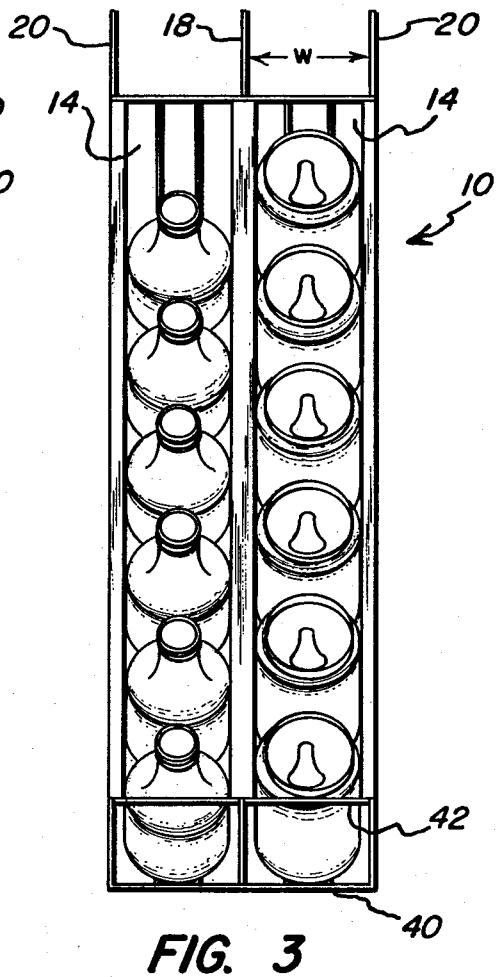
FIG. 3 is an end view of the receptacle of FIG. 1.
Figure 4:
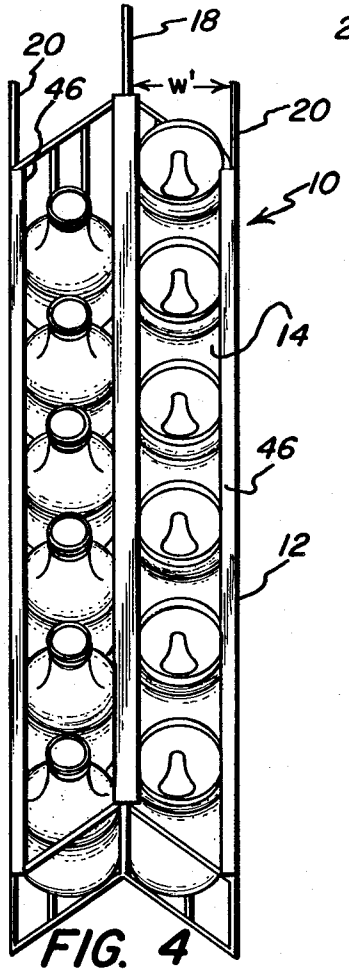
FIG. 4 is an end view of the receptacle of FIG. 1 wherein the receptacle has been lifted for transport.

Referring to FIG. 3, the width "w" of each module is preferably slightly greater than the width of the container that the module is designed to receive. The extra space is believed preferable to facilitate ready storage and removal of containers within receptacle 10. In the embodiment shown, the extra space is eliminated when receptacle 10 is lifted for transport via a partial collapsing of frame structure 12 along predefined lines as shown in FIG. 4. Specifically, structure 12 partially collapses when lifted such that the sides of modules 14 engage the containers retained therein, thereby further enhancing securement of the containers within the receptacle when transported.

Retaining lips or rims 46 are also provided at the outward facing open end 22 of each module 14 for further securing containers 16 within receptacle 10 when in transport. As shown in FIGS. 1 and 2, each module 14 is sized to fully receive a standard 12 oz. soda can therein such that rims 46 serve to engage the outer facing end of each can when receptacle 10 is lifted for transport as shown in FIG. 4. Further, due to the tapering at the neck of most returnable bottles, rims 46 engage the main body of a bottle stored within the receptacle when lifted for transport, again as shown in FIG. 4, notwithstanding that the bottles may protrude beyond open ends 22 of module 14.

Figure 5:
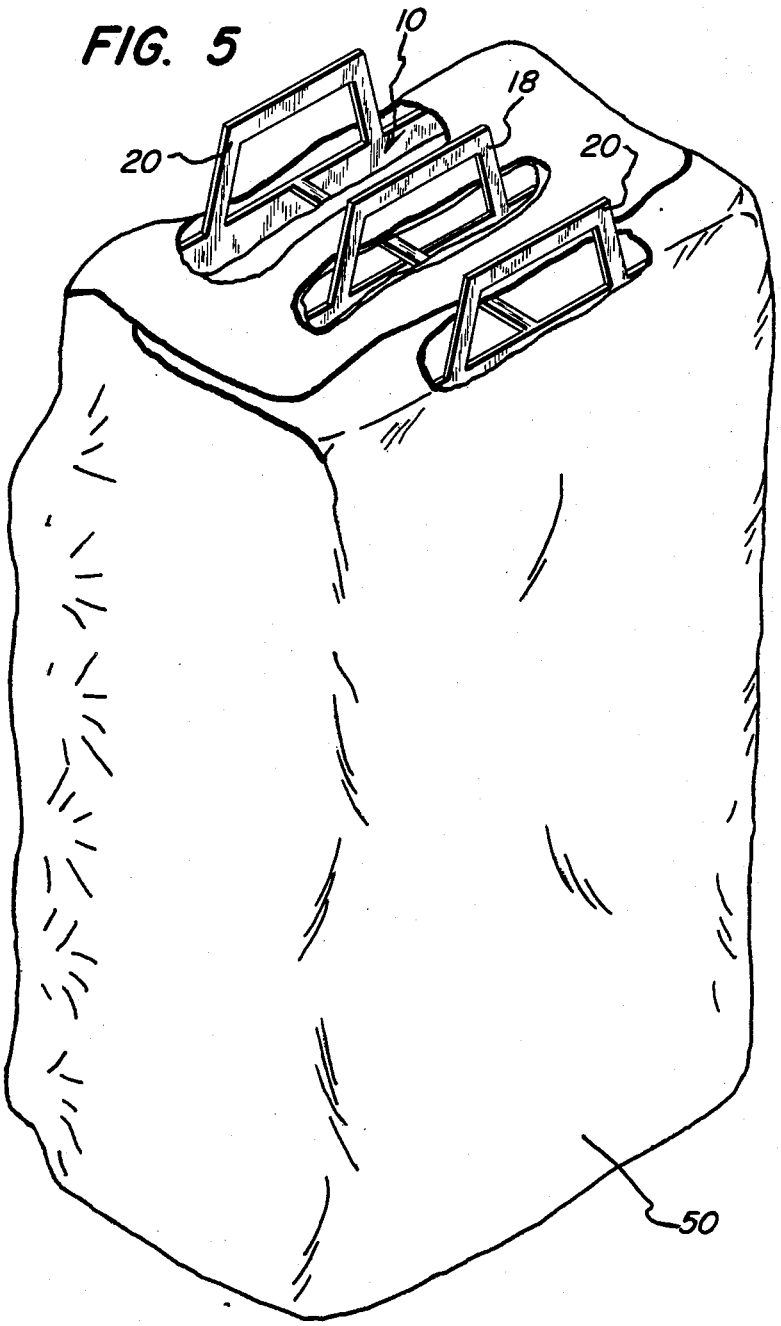
FIG. 5 is a perspective view of the receptacle of FIG. 1 wherein a cover is provided surrounding the receptacle.

As a positive means of retaining empty beverage containers within receptacle 10 when in transport, a cover, such as that shown in FIG. 5, and generally denoted 50, may be provided. Cover 50 preferably is manufactured of a durable, flexible plastic material and includes an opening at its top through which handle 18, and/or handles 20, may be grasped. A cover is believed beneficial for preventing containers from spilling from receptacle 10 should the receptacle be accidentally dropped or otherwise tipped over.

Figure 7:
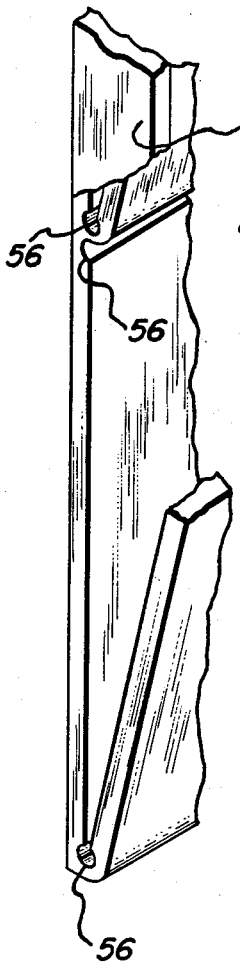
FIG. 7 is an expanded end view of area 7—7 in FIG. 6.
Figure 6:
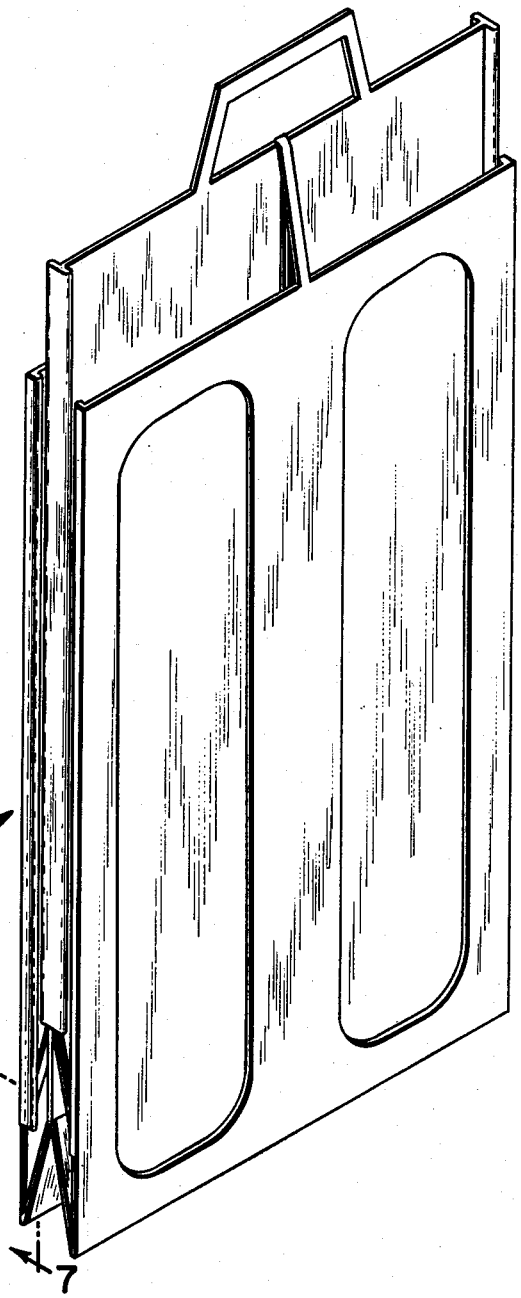
FIG. 6 is a perspective view of the receptacle of FIG. 1 shown in a collapsed position.

Another preferred feature of the present invention, i.e., collapsability, is illustrated in FIGS. 6 and 7. Preferably, the receptacle is designed to be collapsible when empty to facilitate its storage. One known means for providing this collapsibility feature to receptacle 10 is to include hinge points of reduced thickness 56 at the appropriate locations within the frame structure.

Figure 8:
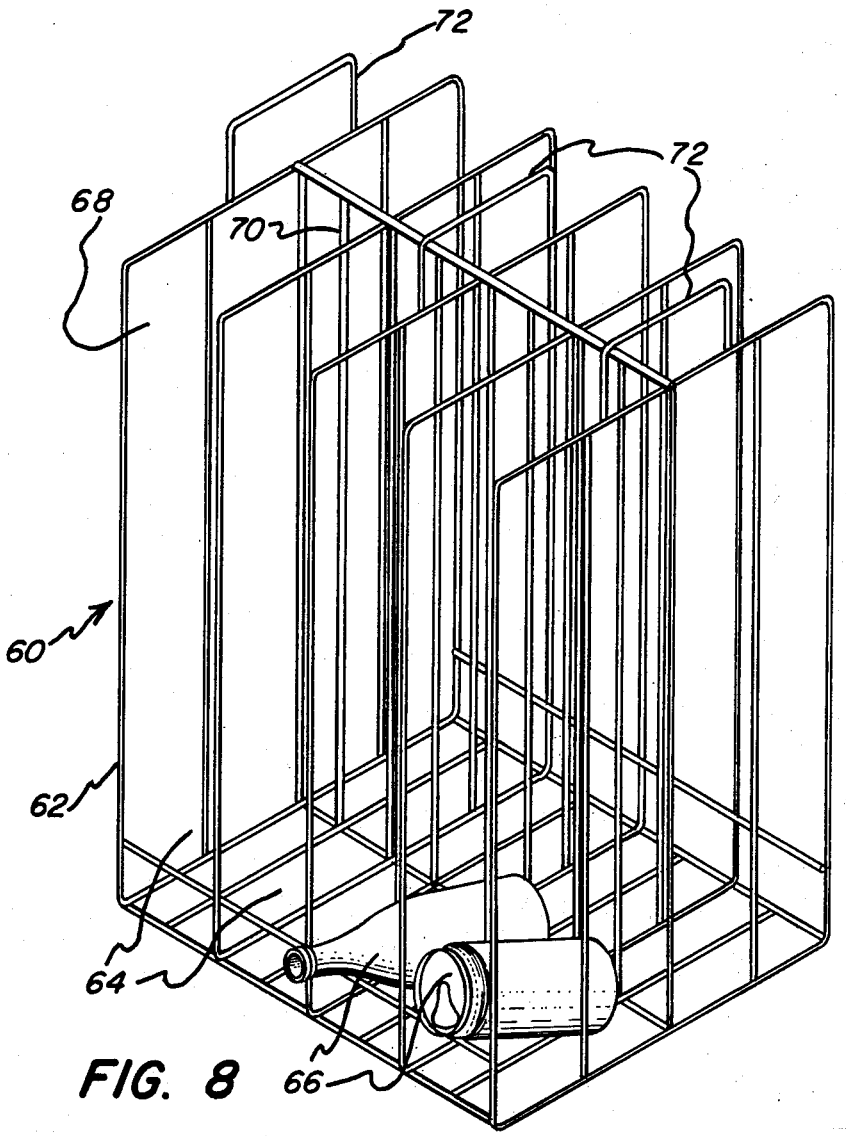
FIG. 8 is a perspective view of an alternate embodiment of the receptacle of the present invention.

An alternate embodiment of the receptacle of the present invention, generally denoted 60, is shown in FIG. 8. In this embodiment, receptacle 60 is manufactured of an open construction, such as a plastic coated wire frame material. Again, modules 64 are symmetrically arranged within the receptacle's frame structure 62. In this case, eight modules are provided. If desired, a cover as illustrated in FIG. 5 could also be included. As with the previous embodiment, containers 66 positioned within the modules are angled downwardly from each module's open end 68 to an opposed, at least partially sealed end 70. Multiple handles 72 are also provided.

It will be observed from the above that the present invention fully meets the objectives set forth herein. A novel receptacle is provided for efficiently and securely receiving returnable beverage containers for storage and transport Further, such a receptacle is provided wherein residue fluid within stored containers will not readily leak when in transport. Also, a receptacle is provided wherein the number of containers accumulated therein can be readily determined.

Although several embodiments of the receptacle of the present invention have been illustrated in the accompanying drawings and described in the foregoing detailed description, it will be understood that the invention is not limited to the particular embodiments described herein, but is capable of numerous rearrangements, modifications and substitutions without departing from the scope of the invention. For example, the number, size and shape of the modules within the receptacle may change, e.g., three modules could be defined wherein two of the three are sized for receiving standard size 12 or 16 oz. cans or bottles and the third is sized for receiving quart or liter size returnable beverage containers. Other changes will suggest themselves to those skilled in the art. The following claims are intended to encompass all such modifications.

I claim:

1. A receptacle for storing and transporting returnable beverage containers, said receptacle comprising:

portable frame structure, said structure having at least one module sized to receive a plurality of returnable beverage container, said at least one module having an outwardly facing open end and an at least partially sealed end opposed thereto, said open end allowing positioning of said plurality of containers within said at least one module, said at least one module including means for orienting said containers within said module such that the containers are angled downwardly from said open module end to said at least partially sealed end, said at least one module being sized such that said containers remain so angularly orientated when stored and when transported within the receptacle, whereby residue fluids within said containers remain therein when the containers are positioned within said module with their tops facing outward at said open end of said module, and said orienting means enhances retention of said beverage containers within said at least one module when said receptacle is utilized to transport said containers.

2. The receptacle of claim 1, wherein said at least one module receives said plurality of returnable beverage containers in tiers, each of said tiers being oriented such that said received containers are angled downwardly from said open module end to said at least partially sealed end.

3. The receptacle of claim 2, wherein said frame structure includes a plurality of container receiving modules, each of said modules having said means for orienting said containers downwardly from the module's open end to its at least partially sealed end.

4. The receptacle of claim 3, wherein said orienting means position said containers at an angle in the range of 10° to 50° to horizontal.

5. The receptacle of claim 3, wherein said plurality of container receiving modules are symmetrically arranged within said frame structure.

6. The receptacle of claim 3, wherein each container tier within each of said modules consists of a single beverage container.

7. The receptacle of claim 3, wherein said frame structure has a top surface and said receptacle further comprises a carrying handle positioned approximately central the top of said structure.

8. The receptacle of claim 3, wherein each module has two sides and includes an elongated opening within at least one of its sides to facilitate counting the number of containers stored therein.

9. The receptacle of claim 3, wherein said frame structure is manufactured of an open frame construction.

10. The receptacle of claim 1, wherein said frame structure is collapsible when empty of beverage containers.

11. The receptacle of claim 9, wherein said frame structure is manufactured of a plastic material and includes areas of reduced thickness definitive of hinges which allow said structure to collapse when empty of beverage containers.

12. The receptable of claim 1, further comprising a cover positionable over said frame structure for retaining beverage containers within said structure when used to transport said containers.

13. The receptacle of claim 1, wherein said at least one module has opposing side surfaces, said side surfaces being partially collapsible to frictionally engage the containers within said module when said receptacle is lifted for transport.

14. The receptacle of claim 13, further comprising retaining lips at the side surfaces of said module adjacent said outwardly facing open end.

15. The receptacle of claim 14, wherein said at least one module's sizing, said orienting means, said partially collapsible side surfaces and said retaining lips all cooperate to securely hold said containers at said angular orientation when the containers are stored within the receptacle and when the containers are transported in the receptacle.

16. The receptacle of claim 15, wherein said orienting means includes one of a strap and a bar interconnecting said at least one module side surfaces proximate said open end.

* * * * *